United States Patent [19]

Becker et al.

[11] 4,304,187

[45] Dec. 8, 1981

[54] MONORAIL SYSTEM

[75] Inventors: Klaus Becker, Wetter; Ferdinand Nolte, Hagen; Karl-Ernst Kaufmann, Wetter, all of Fed. Rep. of Germany

[73] Assignee: Mannesmann DeMag AG, Duisburg, Fed. Rep. of Germany

[21] Appl. No.: 103,383

[22] Filed: Dec. 13, 1979

[30] Foreign Application Priority Data

Dec. 27, 1978 [DE] Fed. Rep. of Germany ..... 2856164

[51] Int. Cl.[3] ..... B61B 13/02; B61B 13/06; B61C 11/04; B61C 13/08

[52] U.S. Cl. ..... 104/12 D; 105/29 R; 105/30; 105/141; 105/142; 105/145; 238/148; 404/21

[58] Field of Search ..... 105/29 R, 30, 31, 145, 105/153, 141, 142; 238/123, 148; 104/60, 61, 69, 12 D; 404/6, 15, 19, 20, 21, 72

[56] References Cited

U.S. PATENT DOCUMENTS

| | | | |
|---|---|---|---|
| 217,085 | 7/1879 | Field | 238/148 |
| 637,005 | 11/1899 | Knudsen | 105/29 R |
| 991,954 | 5/1911 | Charbonneau | 105/29 R |
| 1,089,613 | 3/1914 | Wixom | 404/21 |
| 1,412,504 | 4/1922 | Byrne | 404/20 |
| 1,956,976 | 5/1934 | Bennington et al. | 238/148 X |
| 2,051,821 | 8/1936 | Christiansen | 105/141 X |
| 2,322,965 | 6/1943 | McNeil | 404/19 X |
| 2,987,013 | 6/1961 | Rosenbaum | 104/120 X |
| 3,196,763 | 7/1965 | Rushton | 404/19 X |
| 3,459,134 | 8/1969 | Shepheard | 105/29 R |
| 3,884,153 | 5/1975 | Sugimoto | 238/123 X |
| 4,241,664 | 12/1980 | Cable | 105/141 X |

FOREIGN PATENT DOCUMENTS

| | | | |
|---|---|---|---|
| 291326 | 7/1971 | Austria | 238/148 |
| 12030 Ad.12030 | of 1908 | United Kingdom | 238/148 |

*Primary Examiner*—Joseph F. Peters, Jr.
*Assistant Examiner*—Howard Beltran
*Attorney, Agent, or Firm*—Mandeville and Schweitzer

[57] ABSTRACT

A monorail system having a rail surface that is provided for small vehicles traversing an incline or slippery areas, with the surface having a plurality of spaced recesses positioned in those areas to form gripping edges for the drive wheels of the vehicles. The recesses may be of a variety of shapes and positioned in different ways to provide the proper grip. The recesses may be mechanically punched into a separate elongated flat bed riveted in appropriate locations to the rail. The punching may be done in such a way so as to form raised ramp-like edges adjacent the recesses to help with the gripping action. The ramp faces face downwardly in inclined areas. The drive wheels of cooperating vehicles may have elastic treads to help with the gripping action.

4 Claims, 8 Drawing Figures

Fig. 2
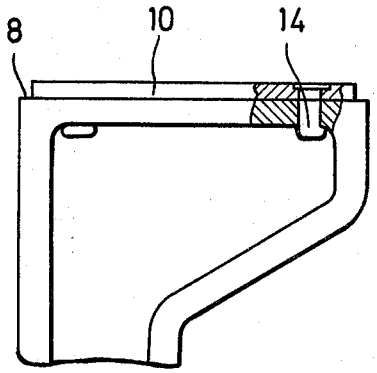
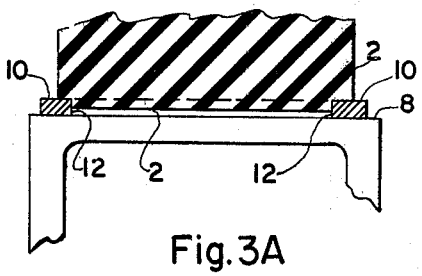
Fig. 3A
Fig. 3
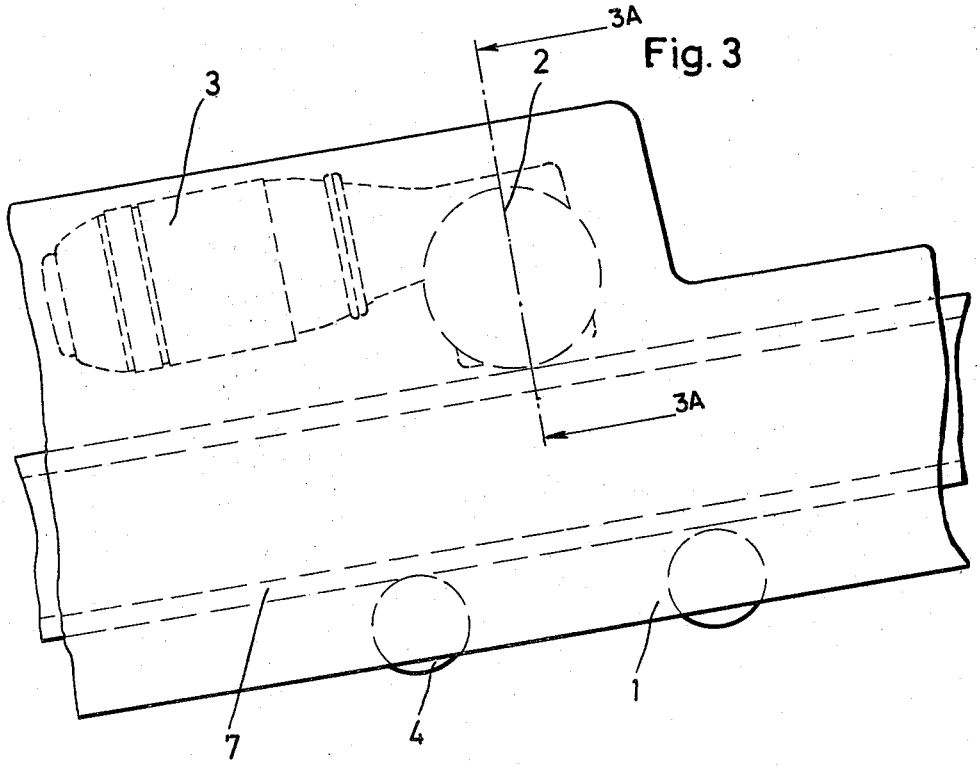

MONORAIL SYSTEM

BACKGROUND AND DESCRIPTION OF THE INVENTION

This invention relates to a monorail system having a rail for a vehicle which is provided with at least one rubber tired or resilient drive wheel. In all known rail vehicles, there is a risk of skiding on ascending and descending sections, as well as during a fast start. In mountain trains, this is eliminated by means of auxiliary racks between the rails and auxiliary pinions. This solution, however, requires devices which make for a correspondence between the pinion teeth and the rack teeth. Such involved devices may be justifiable for large trains and mountains trains, but not for small vehicles, such as those in recreational facilities, as well as in trolleys which have to negotiate considerable inclines within plant conveyer systems.

It is, therefore, the object of the invention to form a rail for a vehicle so that great ascending and descending sections may be negotiated with little expenditure, and that even with fast acceleration and deceleration, the rubber tired drive wheel does not slide even in extremely severe weather conditions, such as when there is rain, snow or ice on the rail. This is solved by providing the rail bearing surface for the drive wheel with recesses forming gripping edges. The gripping edges form a stable frictional form fit for the rubber tired drive wheel, and are preferably arranged in the area of ascending and descending sections of a rail installation, as well as in those areas where the vehicles must be accelerated and decelerated.

The recesses are, preferably, arranged in a separate rail bedding joined to the rail bearing surface. This rail bedding may have a ramp-like configuration in the transitions to the bearing surface and consists, preferably, of a flat profile provided with the recesses and attached to the rail bearing surface by means of rivets. In order to increase effectiveness, the gripping edges may be formed as elevations or ridges positioned at right angles to the rail, and jutting out past the surface of the rail bedding, in that area of the recesses which face the valley in ascending and descending rail installation areas. The recesses facilitate the reception of dirt and ice which might impair the efficiency of the gripping edges. The recesses may consist of long holes positioned at right angles to the course direction, or in a zig-zag arrangement. They may also be round and offset from each other in the course direction, as they are not as wide as the rail bedding.

Preferably, the rail bedding is made of high strength steel. It may also be made of carbon steel, which is subsequently galvanized. Galvanization is preferred, especially in recess areas, due to its imperviousness. The recesses of the rail bedding may be made by punching. At the same time, the mentioned elevations may be brought about by proper design of the punch or blanking tool. Gripping edges of this kind permit rubber tired vehicles to negotiate inclines of about 50% and above. Even icing on the rail due to freezing rain at temperatures below the freezing point does not affect passage of the vehicles, as the sharp gripping edges, upon pressure against the wheel of the vehicle, penetrate the ice, and thus establish contact with the wheel. No heating of the rail is required. The rail bedding may be adapted to the vertical curvatures of the rail by simple bending, and may be easily adapted to the horizontal curvatures by incisions in the adjacent wall areas.

The gripping edges of the rail bedding are especially effective with drive wheels with elastic tire treads made of rubber or Vulkollan (i.e. natural, synthetic, or thermoplastic rubber); such resilient drive wheels cause only a low noise level not exceeding 65 dBA (decibels). Furthermore, there is little wear on the wheel treads, as well as on the rail bedding.

Several examples of the invention are shown in the drawings, and explained as follows.

DESCRIPTION OF THE DRAWINGS

FIG. 2 is an enlarged cross sectional view through part of the rail of FIG. 1, with a rail bedding;

FIG. 3 is a somewhat diagrammatic system sketch for the arrangement of the drive wheel on the rail of FIG. 1;

FIG. 3*a* is a fragmentary cross-sectional view taken along line 3A—3A of FIG. 2 showing the engagement of the rubber tire with the rail;

DETAILED DESCRIPTION OF THE INVENTION

Figure 1:
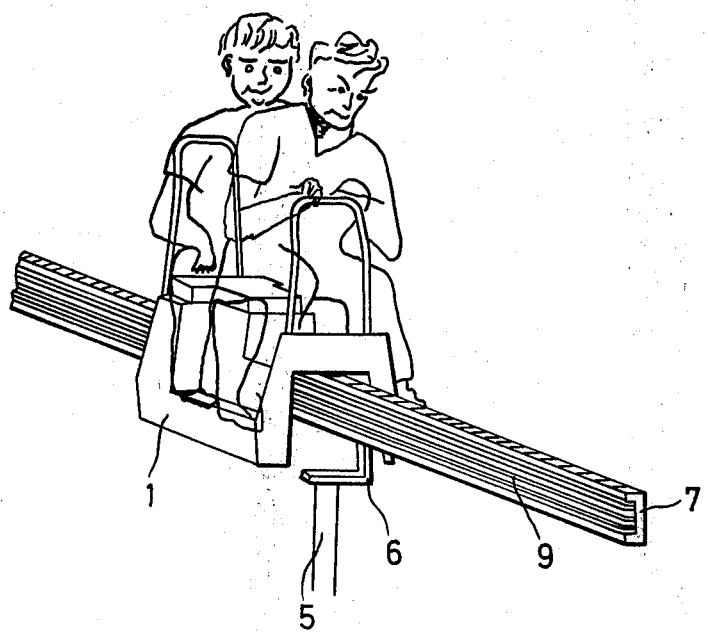
FIG. 1 is a perspective view of a rail section showing a vehicle for passengers arranged in a recreational area with an incline.

FIG. 1 shows a vehicle 1 with two passengers on a monorail system having a rail 7, supported by supports 5 via brackets 6. A rail bedding 10 is attached with rivets 14 to its wheel bearing surface 8, as shown in FIG. 2. The side of the rail 7 is provided with slide contact lines 9 to supply current to the motor 3, shown in FIG. 3, for the drive wheel 2. The drive wheel 2 is the only supporting wheel for the vehicle 1, which is provided with two counter-wheels 4. At least one of the counter-wheels 4 always adheres to the bottom of the rail 7.

Figure 4:
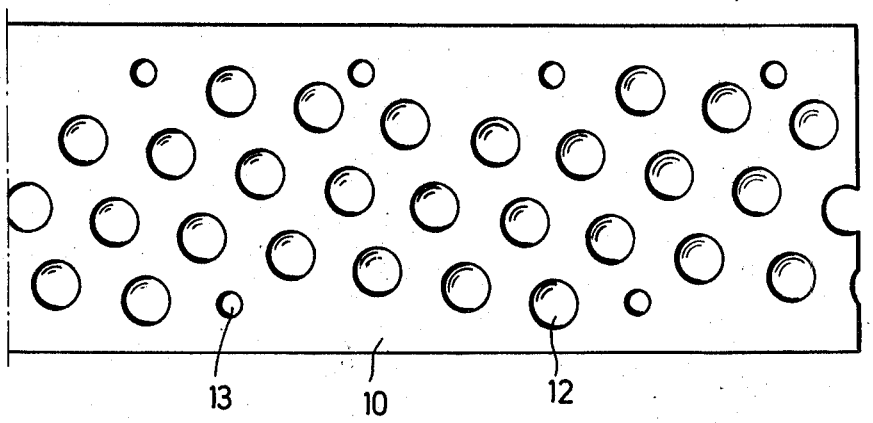
FIG. 4 is an enlarged top plan view of a rail bedding surface illustrating the invention.

FIG. 4 shows a rail bedding 10 with a large number of round recesses 12, together with boreholes 13 for the rivets 14 for attachment to the rail 7. The recesses 12 are offset so that at least one gripping edge formed of the edge of the recesses 12 is in form/friction contact with the rubber tired drive wheel 2.

Figure 5:
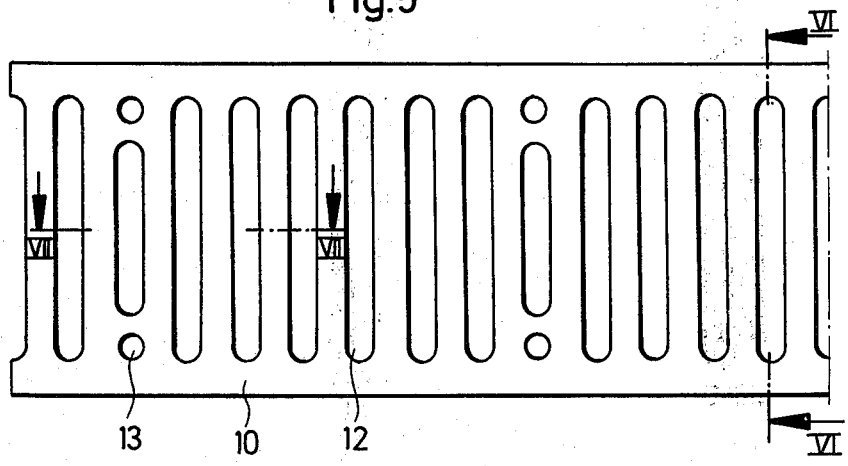
FIG. 5 is an enlarged top plan view of another embodiment of rail surface illustrating the invention.
Figure 7:
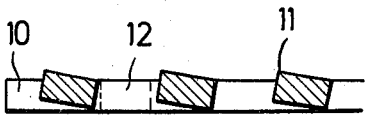
FIG. 7 is a sectional view taken along lines VII—VII of FIG. 5.
Figure 6:
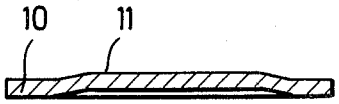
FIG. 6 is a sectional view taken along lines VI—VI of FIG. 5.

The recesses 12 consist, in the example according to FIGS. 5 through 7, of long holes positioned at right angles to the rail bedding 10 and are provided with gripping edges 11 jutting out ramp-like beyond the surface of the rail bedding 10, which is clearly indicated in FIGS. 6 and 7. FIG. 7 shows also that the protruding gripping edges 11 were manufactured by means of an appropriate design of the punch.

What is claimed is:

1. A monorail system having a flat rail structure for supporting traversing, resilient tired vehicle drive wheels comprising:

(a) an elongated narrow rail body having a planar load bearing upper surface;

(b) an elongated narrow rail means having parallel spaced planar upper and lower surfaces;

(c) means fastening said rail means to said rail body with said planar load bearing surface in face-to-face contact with said planar lower surface of said rail bedding, whereby said planar upper surface of said rail bedding presents an exposed flat wheel bearing surface, for engaging said resilient tired drive wheels;

(d) a multiplicity of endless rectilinear walls forming edges in said rail means and extending from said upper to said lower surfaces thereof, said edges defining predetermined closed geometrical configurations forming a series of openings;

(e) the uppermost portions of said walls intersecting with said planar outer wheel bearing surface of said rail bedding to define a plurality of sharp gripping edges;

(f) whereby traction between a resilient tired drive wheel traversing said upper planar surface of said rail means is adapted to be enhanced by engagement of said resilient tires drive wheel with said sharp edges and with upper portions of said walls as said tired wheel traverses said rail.

2. The rail structure of claim 1, further characterized in that (a) said edges forming said openings are generally rectangular in configuration and are arranged perpendicularly to the longitudinal axis of said rail structure.

3. The rail structure of claim 1, further characterized in that (a) said edges forming said openings are circular and are arrayed in staggered rows along the longitudinal axis of said rail.

4. The rail structure of claim 1, further characterized in that (c) said means for fastening said rail means to said rail body are a plurality of rivets arrayed proximate to the side edges of said rail.

* * * * *